US006736899B1

(12) United States Patent
Abe et al.

(10) Patent No.: US 6,736,899 B1
(45) Date of Patent: May 18, 2004

(54) ELECTROSTATIC PROCESSING CHAMBER ARRANGED IN ELECTROSTATIC FLOCKING APPARATUS AND ELECTROSTATIC COATING APPARATUS

(75) Inventors: Masaaki Abe, Tokyo (JP); Teruyuki Tatsumi, Tokyo (JP)

(73) Assignees: Mesac Corporation, Tokyo (JP); Sumitomo Corporation, Osaka (JP)

( * ) Notice: Subject to any disclaimer, the term of this patent is extended or adjusted under 35 U.S.C. 154(b) by 172 days.

(21) Appl. No.: 09/642,634

(22) Filed: Aug. 22, 2000

(30) Foreign Application Priority Data

Aug. 23, 1999 (JP) ..... 11-235030

(51) Int. Cl.[7] ..... B05B 5/14

(52) U.S. Cl. ..... 118/634; 118/627; 118/621; 118/620

(58) Field of Search ..... 118/620, 621, 118/627, 640, 630, 634, 500; 427/458, 462, 472, 473, 474, 482, 200, 206

(56) References Cited

U.S. PATENT DOCUMENTS 2,279,361 A * 4/1942 Amstuz ..... 427/463

3,868,925 A * 3/1975 Smith et al. ..... 118/621

* cited by examiner

*Primary Examiner*—Richard Crispino
*Assistant Examiner*—George R. Koch, III
(74) *Attorney, Agent, or Firm*—Rader, Fishman & Grauer PLLC

(57) ABSTRACT

In order to obtain an evenly flocked and an evenly coated surface of a strip-like elongated workpiece, any slack of the strip-like elongated workpiece is removed not to affect the workpiece when the workpiece travels through an electrostatic flocking and an electrostatic coating chamber at high speed. A slack of the workpiece occurs due to its own weight under the influence of gravity when the workpiece travels through the electrostatic flocking and the electrostatic coating chamber at high speed. A V-shaped oblique surface portion of the workpiece is forcibly defined by a pressure roller in a position corresponding to that of the slack of the strip-like elongated workpiece. An electrode is disposed in parallel to the workpiece's V-shaped oblique surface portion defined by the pressure roller.

2 Claims, 1 Drawing Sheet

ELECTROSTATIC PROCESSING CHAMBER ARRANGED IN ELECTROSTATIC FLOCKING APPARATUS AND ELECTROSTATIC COATING APPARATUS

BACKGROUND OF THE INVENTION

1. Field of the Invention

The present invention relates to an electrostatic processing chamber, which serves as an electrostatic flocking chamber and an electrostatic coating chamber arranged in an electrostatic flocking apparatus and an electrostatic coating apparatus, respectively, wherein: a strip-like elongated workpiece such as steel strips, non-ferrous metal strips and the like is wound into a coil; the coil of the workpiece thus wound is mounted on a delivery unit; in operation, the workpiece of the coil is then unwound and delivered from the delivery unit to assume a strip-like elongated flat plate shape; subsequent to this, the flat plate-shaped workpiece is subjected to an electrostatic flocking operation and an electrostatic coating operation when passed through an electrostatic flocking chamber and an electrostatic coating chamber, respectively, in a condition in which the workpiece is electrically grounded; and, after that, the workpiece is subjected to an after-treatment, and then successively taken up in a take-up unit.

2. Description of the Related Art

When an electrostatic flocking operation and an electrostatic coating operation are performed: an object (to be processed) called "workpiece" is electrically grounded, and oppositely disposed from and spaced a predetermined distance apart from an electrode which is arranged in each of an electrostatic flocking chamber and an electrostatic coating chamber; an high voltage electrostatic energy is applied to the electrode to create an electrostatic field between the workpiece and the electrode, wherein electric lines of force of the electrostatic field thus created extend from the electrode toward the workpiece; at this time, using the electric lines of force, an immense number of short fibers and fine particles of an electrically insulating coating material are floated and electrostatically charged, and therefore electrostatically driven to fly to the workpiece in each of the electrostatic flocking chamber and the electrostatic coating chamber in a manner such that the short fibers and the fine coating material particles are evenly implanted into and applied to the workpiece.

In the electrostatic flocking process and the electrostatic coating process described above, the workpiece is often stationarily supported on a support member which is electrically grounded in each of the electrostatic flocking chamber and the electrostatic coating chamber. At this time, it is also possible to move the workpiece so as to pass through the electrostatic flocking chamber and the electrostatic coating chamber in the electrostatic flocking process and the electrostatic coating process. Further, even when the electrostatic processing operations described above are performed in a condition in which the workpiece is electrically grounded without using the support member, in order to evenly implant and evenly apply the short fibers and the fine particles of coating material into and to the workpiece, it is necessary to perform the above operations for a calculated predetermined operation period of time in a condition in which the workpiece is always spaced a predetermined distance apart from the electrode.

Consequently, in the electrostatic flocking and the electrostatic coating operation of the workpiece traveling through the electrostatic flocking chamber and the electrostatic coating chamber, it is inevitably required to review: the operation period of time required for each of the electrostatic flocking operation and the electrostatic coating operation; and, a traveling speed of the workpiece, at which speed the workpiece travels through each of the electrostatic flocking chamber and the electrostatic coating chamber.

As for types of means for performing both the electrostatic flocking operation of the short fibers and the electrostatic coating operation of the fine particles of coating material, the following types of means are considered: a down-type means, in which the electrode is disposed over the workpiece, while the short fibers and the fine particles of coating material are delivered from above the workpiece to perform the electrostatic flocking operation and the electrostatic coating operation; an up-type means, in which the electrode is disposed under the workpiece, while the short fibers and the fine particles of coating material are delivered from under the workpiece to perform the electrostatic flocking operation and the electrostatic coating operation; and, a side-type means, in which the electrode lies in a plane in which the workpiece lies so that the electrode and the workpiece are arranged side by side in the same plane, whereby the short fibers and the fine particles of coating material are delivered from alongside of the workpiece to perform the electrostatic flocking operation and the electrostatic coating operation.

In case that the electrostatic flocking and the electrostatic coating operation are performed in a condition in which the workpiece assuming a strip-like flat plate shape travels through the electrostatic flocking chamber and the electrostatic coating chamber, and, further, when there is no necessity to reduce the operation period of time, there is also no necessity to consider any improvement of each of the conventional electrostatic flocking chamber and the conventional electrostatic coating chamber in construction.

The reason why this is so because it is sufficient for the workpiece to pass through the electrostatic flocking chamber and the electrostatic coating chamber as is in the conventional processes.

In contrast with this, in order to reduce the operation period of time in the electrostatic flocking and the electrostatic coating operation of the workpiece, and, further, in order to improve these operations in operation efficiency, it is necessary to pass the workpiece through the electrostatic flocking chamber and the electrostatic coating chamber at high speed. Furthermore, in order to thickly at a predetermined thickness and evenly implant and apply the short fibers and the fine particles of coating material into and to the workpiece in the electrostatic flocking and the electrostatic coating operation, respectively, it is necessary to pass the workpiece at high speed through an improved electrostatic flocking chamber and an improved electrostatic coating chamber both of which chambers are improved in construction so as to be capable of thickly at a predetermined thickness and evenly implanting and applying the short fibers and the fine particles of coating material into and to the workpiece, respectively.

Due to the above necessity, it is inevitably required to improve in construction both the electrostatic flocking chamber and the electrostatic coating chamber in a manner such that: a traveling distance of the workpiece between an inlet opening and an outlet opening of each of the electrostatic flocking chamber and the electrostatic coating chamber is increased, that is, an area in which the workpiece is oppositely disposed from the electrode is elongated along the workpiece's traveling path, which means an increase in longitudinal length of an electrode area in which the electrode is arranged along the workpiece's traveling path.

In case that the strip-like elongated object or workpiece is light in weight as is in the case of a sheet of paper or cloths: the workpiece is arranged to pass through the electrostatic flocking chamber and the electrostatic coating chamber, in each of which chambers the electrode area described above is increased in its longitudinal length along the workpiece's traveling path; in performing the electrostatic flocking and the electrostatic coating operation in a condition in which the workpiece travels, there is no fear that the distance between the workpiece and the electrode varies in each of the electrostatic flocking chamber and the electrostatic coating chamber when the workpiece travels through these chambes, since there is substantially no slack in the workpiece when the workpiece is pulled vertically and horizontally so as to travels from the inlet opening to the outlet opening of each of the electrostatic flocking chamber and the electrostatic coating chamber.

Consequently, without specially modifying in construction each of the conventional up-type, the conventional down-type, and the conventional side-type of each of the electrostatic flocking chamber and the electrostatic coating chamber, it is possible to perform the electrostatic flocking and the electrostatic coating operation of the workpiece.

However, in contrast with the case of each of the sheet of paper, cloths and like light-weight workpieces, when the workpiece 1 is any one of steel strips, steel plates and stainless steel strips: since the workpiece 1 is a metal sheet, it is difficult for the workpiece 1 due to its heavy weight to keep its straight shape in both a vertical and a horizontal plane under the influence of gravity when the workpiece 1 travels from the inlet opening 3 to the outlet opening 4 of each of the electrostatic flocking and the electrostatic coating chamber 2. When the workpiece 1 travels in the horizontal plane except the vertical plane, the workpiece 1 suffers from its slack in the electrostatic flocking and the electrostatic coating chamber 2, as shown in FIG. 1. As a result, it is impossible for the workpiece 1 to keep constant the distance between the workpiece 1 and the electrode 5 in a horizontal plane, wherein the electrode 5 is arranged in each of the electrostatic flocking and the electrostatic coating chamber 2.

Any slack produced in the workpiece 1 traveling from the inlet opening 3 to the outlet opening 4 in each of the electrostatic flocking and the electrostatic coating chamber 2 does not satisfy the above-mentioned condition that the distance between the electrode 5 and the workpiece 1 should be kept constant at any time when the electrostatic flocking and the electrostatic coating operation are performed in order to thickly and evenly implant and apply the short fibers and the fine particles of coating material into and to the workpiece 1, respectively. More specifically, when the workpiece 1 slacks to produce a slacked portion and a slack-free portion in the workpiece 1. Due to the presence of such slacked portion and the slack-free portion of the workpiece 1, the distance between the workpiece 1 and the electrode 5 varies in the electrostatic field. This causes variations in line density of the electric lines of force extending from the electrode 5 toward the workpiece 1 in the electrostatic field created between the electrode 5 and the workpiece 1.

The electrostatic flocking and the electrostatic coating operation both performed under the above-mentioned phenomenon fail to evenly drive the short fibers and the fine particles of coating material so as to fly from the electrode 5 toward the workpiece 1, which disadvantageously results in a poorly flocked product and a poorly coated product.

Since in the prior art there is no idea that the workpiece is forced to travel through the electrostatic flocking and the electrostatic coating chamber at high speed, any consideration is not made in this respect in the prior art.

Since the electrostatic flocking process and the electrostatic coating process are based on the same principle, such principle will be first described.

Each of the technology of the electrostatic flocking process and the technology of the electrostatic coating process is based on an essential idea that: the electrode, to which the high voltage electrostatic energy is applied, is provided; the electrostatic processing chamber havs a construction in which the electrode is oppositely disposed from the workpiece which is electrically grounded, wherein the high voltage electrostatic energy is applied to the electrode so that the workpiece is electrically charged; the electrostatic field is produced between the electrode and the workpiece to make it possible to use its electric lines of force in electrically charging the fine things which float between the electrode and the workpiece in the electrostatic processing chamber forming a housing; and, the fine things thus electrically charged are driven to fly toward the workpiece being electrostatically processed.

The technology of the electrostatic flocking process considerably differs from the technology of the electrostatic coating process in the following points: the technology of the electrostatic flocking process uses the short fibers as the fine things, wherein the short fibers are electrostatically charged; the workpiece to be electrostatically processed is electrically grounded , and has its surface coated with an adhesive layer which remains undry; and, the short fibers are electrostatically driven to fly toward the adhesive layer of the workpiece, and have their front end portions implanted into the adhesive layer of the workpiece under the effect of electric lines of force appearing in the electrostatic field created between the electrode and the workpiece, whereby the workpiece is flocked with the short fibers.

On the other hand, in the technology of the electrostatic coating process: the fine things floating in the housing for performing the electrostatic processes are the fine particles of a powder coating material or of a liquid coating material; the workpiece is electrically grounded, and not coated with any adhesive layer; the fine things of the liquid coating material or of the powder coating material are electrostatically charged; the electrostatic field is created between the electrode and the workpiece to produce the electric lines of force; and, by using these electric lines of force, the fine things of the liquid or powder coating material are electrostatically driven to fly toward a surface of the workpiece, whereby the liquid or power coating material is adhered to the surface of the workpiece under the effect of the electrostatic energy.

Both the above processes are based on the same principle that: the electrostatic field is created between the workpiece and the electrode; and, the electric lines of force appearing in the electrostatic field are used in the processes. However, these processes differ from each other in the conditions of the workpiece and in material of the fine things which are electrostatically charged and floated.

In other words, the above processes are identical with each other in that the housing which forms the electrostatic processing chamber has a construction in which: the electrode is arranged so as to be oppositely disposed from the workpiece electrically grounded; and, the electrostatic field is created between the electrode and the workpiece, which produces the electric lines of force extending from the electrode toward the workpiece.

SUMMARY OF THE INVENTION

In view of the above circumstances, the present invention was made. Consequently, it is an object of the present invention to realize an even flocking and an even coating operation of a workpiece, under the condition that: a work piece, for example such as elongated ferrous metal plates, non-ferrous metal plates and the like, is wound into a coil and has its surface coated with an adhesive layer; the workpiece of the coil is unwound to assume a strip-like elongated shape; when the elongated workpiece is subjected to an electrostatic flocking and an electrostatic coating process, any slack of the workpiece due to its own weight under the influence of gravity is forcibly prevented from occurring when the workpiece travels through each of an up-type electrostatic flocking and coating chamber from its inlet opening to its outlet opening, wherein an electrode area in which an electrode is arranged is increased in its longitudinal direction along the workpiece's traveling path; when the workpiece travels through the electrostatic flocking and the electrostatic coating chamber, the workpiece is always spaced a predetermined distance apart from the electrode arranged in each of the electrostatic flocking and the electrostatic coating chamber, so that it is possible to prevent the electric lines of force extending from the electrode toward the workpiece from varying in intensity at the surface of the workpiece, wherein the slack of the workpiece causes the electrostatic field created between the workpiece and the electrode to vary in intensity at the surface of the workpiece, which causes in turn the electric lines of force extending from the electrode to the workpiece to vary in intensity at the surface of the workpiece described above, whereby the short fibers and the fine particles of coating material are electrostatically driven to fly from the electrode toward the workpiece in a predetermined condition; and, under such predetermined condition, it is possible to realize an even thickness flocking and an even thickness coating operation of the workpiece.

The above object of the present invention is accomplished by providing:

A structure of an electrostatic processing chamber of an electrostatic flocking apparatus, wherein: a strip-like elongated workpiece is constructed of a metal strip of a material selected from the group consisting of ferrous metal and non-ferrous metal, wherein the metal strip has its surface coated with an adhesive layer to form the strip-like elongated workpiece which is wound into a coil, wherein the coil of the workpiece is mounted on a delivery unit; the strip-like elongated workpiece is passed through an electrostatic flocking chamber at high speed so that the workpiece is electrostatically flocked with short fibers; after completion of such electrostatical flocking of the workpiece with the short fibers, the workpiece is subjected to an after-treatment, and then taken up in a take-up unit, characterized in that: a pressure roller for defining a Valley-shaped (V-shaped) oblique surface portion of the workpiece is arranged between an inlet opening and an outlet opening of the electrostatic flocking chamber, wherein the workpiece's V-shaped oblique surface portion substantially corresponds in position to a curved surface portion of the workpiece formed under the influence of gravity due to the workpiece's own weight when the workpiece travels through the electrostatic flocking chamber; and, an electrode is disposed parallel to the V-shaped oblique surface portion of the workpiece.

Further, the above object of the present invention is accomplished by providing:

A structure of an electrostatic processing chamber of an electrostatic coating apparatus, wherein: a strip-like elongated workpiece is constructed of a metal strip of a material selected from the group consisting of ferrous metal and non-ferrous metal, wherein the metal strip is wound into a coil, wherein the coil of the workpiece is mounted on a delivery unit; the strip-like elongated workpiece is passed through an electrostatic coating chamber at high speed so that the workpiece is electrostatically coated with an electrically insulating coating material; after completion of such electrostatical coating of the workpiece with the coating material, the workpiece is subjected to an after-treatment, and then taken up in a take-up unit, characterized in that: a pressure roller for defining a V-shaped oblique surface portion of the workpiece is arranged between an inlet opening and an outlet opening of the electrostatic coating chamber, wherein the V-shaped oblique surface portion of the workpiece substantially corresponds in position to a curved surface portion of the workpiece formed under the influence of gravity due to the workpiece's own weight when the workpiece travels through the electrostatic coating chamber; and, an electrode is disposed parallel to the V-shaped oblique surface portion of the workpiece.

In the structure of the present invention having the above construction: since the workpiece is always spaced a predetermined distance apart from the electrode when traveling a relatively long distance through the electrostatic processing chamber such as the electrostatic flocking chamber and the electrostatic coating chamber, it is possible for the floating short fibers having been electrostatically charged to have their front end portions evenly implant into the adhesive layer of the workpiece, and, further, it is possible to evenly apply the floating fine particles of coating material having been electrostatically charged to the surface of the workpiece.

In other words, it is possible for the present invention to obtain the workpiece having been evenly flocked with the short fibers and the workpiece having been evenly coated with the coating material.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

The present invention may, however, be embodied in various different forms and should not be construed as limited to the embodiments set forth herein; rather, these embodiments are provided so that this disclosure will be thorough and complete, and will fully convey the scope of the present invention to those skilled in the art.

The present invention relates to an up-type electrostatic flocking chamber and an up-type electrostatic coating chamber, which form an electrostatic flocking apparatus and an electrostatic coating apparatus, respectively, each of which apparatuses is constructed of a combined apparatus in which: a strip-like elongated workpiece such as metal plate made of ferrous metal, non-ferrous metal, or, like materials is wound into a coil; the coil of the workpiece is mounted on a delivery unit, from which the strip-like elongated workpiece is unwound and delivered, electrically grounded, and travels through each of the electrostatic flocking and the electrostatic coating chamber by entering the chamber through its inlet opening and leaving the chamber through its outlet opening, wherein the workpiece is spaced a predetermined distance apart from and therefore kept in parallel to an electrode, and subjected to an electrostatic flocking process and an electrostatic coating process; after the workpiece is processed, the workpiece is subjected to a predetermined after-treatment, and then taken up in a take-up unit as a completed product.

In case that the workpiece is flocked to produce the thus completed flocked product, the workpiece previously has its surface coated with an adhesive so as to form an adhesive layer of the workpiece in an adhesive applicator unit. This applicator unit is disposed in front of the electrostatic flocking chamber.

Now, the gist of the present invention will be described with reference to FIG. 2.

Figure 1:
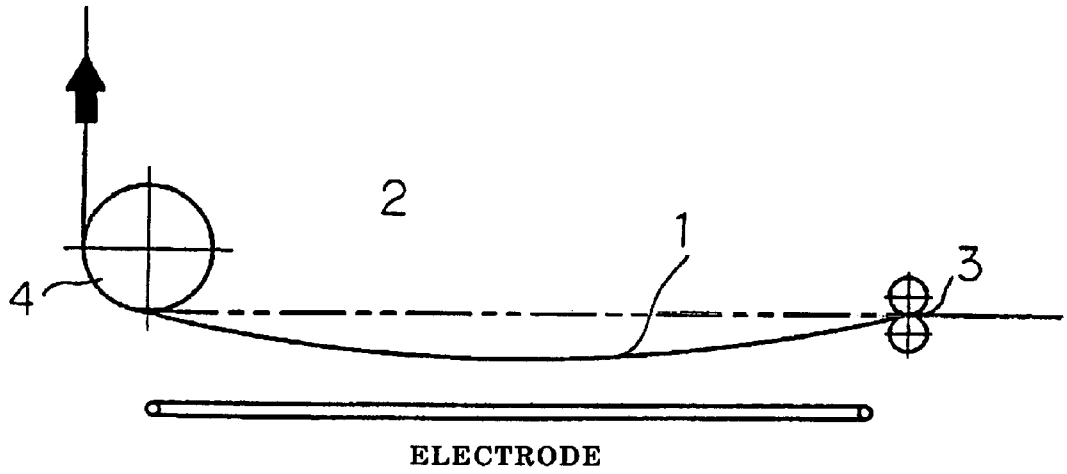
FIG.1(PRIOR ART)
FIG. 1 is a view illustrating the prior art, shown in which is the behavior of the strip-like elongated workpiece observed when the workpiece travels through the electrostatic processing chamber in which any measure is not taken according to the prior art.

In case that any measure is not taken in a predetermined area of the workpiece's path which is arranged inside the electrostatic processing chamber which permits the workpiece to enters the chamber through its inlet opening and also permits the workpiece to leave the chamber through its outlet opening, as shown in the prior art of FIG. 1, a slack is produced in the workpiece due to its own weight under the influence of gravity when the workpiece travels through the electrostatic processing chamber such as the electrostatic flocking chamber and the electrostatic coating chamber.

Figure 2:
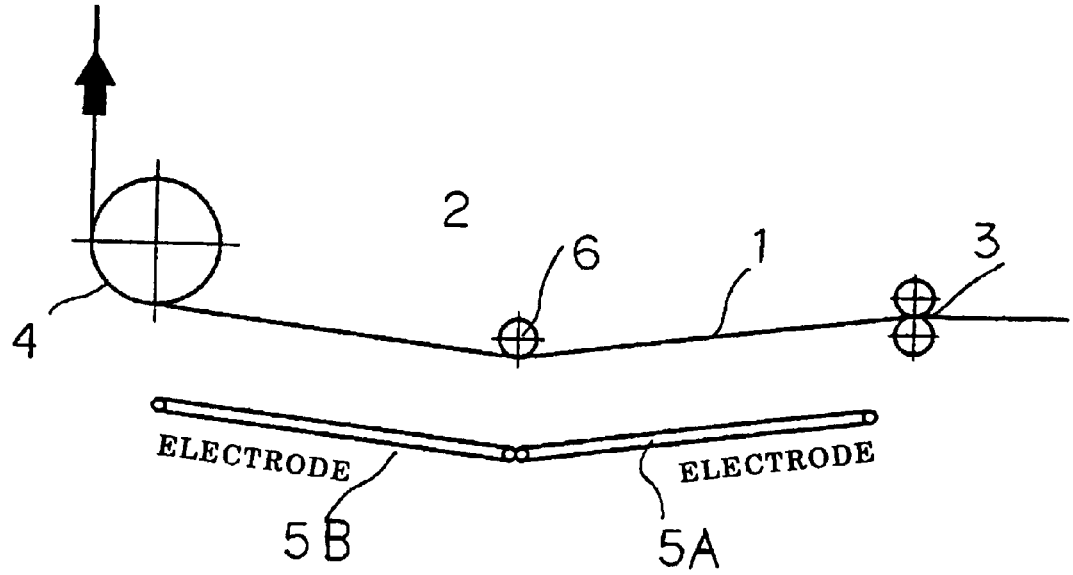
FIG. 2 is a view illustrating the behavior of the strip-like elongated workpiece when the workpiece travels through the electrostatic processing chamber of the present invention.

Consequently, in view of the above, the gist of the present invention resides in that: when the workpiece travels through the electrostatic processing chamber such as the electrostatic flocking chamber and the electrostatic coating chamber, the workpiece is forcibly deformed by a suitable means such as a pressure roller and the like in a manner such that the workpiece has its slacked portion assume a V-shaped oblique surface shape shown in FIG. 2; and, the electrode is disposed parallel with the V-shaped oblique surface shape of the workpiece which is urged downward by the suitable means such as the pressure roller and the like as described above. The V-shaped oblique surface shape of the workpiece appears between the inlet opening and the outlet opening of the electrostatic processing chamber such as the electrostatic flocking chamber and the electrostatic coating chamber. As is clear from FIG. 2, the electrode assumes the same V-shaped oblique surface shape as that of the workpiece.

In the electrostatic flocking process, the above-mentioned suitable means is constructed of a pressure roller 6, which is disposed in a predetermined position adjacent to the workpiece's path through which the workpiece 1 passes through the electrostatic flocking chamber 2. The pressure roller 6 is brought into press contact with an upper surfaces of the workpiece 1 to rotate as the workpiece 1 travels. On the other hand, a lower surface of the workpiece 1 is coated with the adhesive layer. The V-shaped oblique surface shape of the workpiece 1 is forcibly defined by the pressure roller 6.

As for the electrode, as is clear from FIG. 2, the electrode is constructed of a pair of electrodes 5A, 5B. These electrodes 5A, 5B are spaced a predetermined distance apart from and disposed adjacent to the V-shaped oblique surface portion of the workpiece 1 to extend along the workpiece to define a predetermined angle between the electrodes 5A, 5B.

In this construction, it is not required to have both the pressure roller 6 and the electrodes 5A, 5B fixedly mounted in the electrostatic processing chamber such as the electrostatic flocking chamber. It is also possible to control the pressure roller 6 in position and the electrodes 5A, 5B in oblique angle thereof by using a suitable manual or automatic controller. Further, in construction, it is also possible to have the pressure roller 6 interlocked with the electrodes 5A, 5B in a manner such that the oblique angle of the electrodes 5A, 5B changes as the position of the pressure roller 6 changes.

In the interior of the electrostatic flocking chamber 2 having the above construction, when the workpiece 1 moves from the inlet opening (not shown) to the outlet opening (not shown) of the chamber 2 at high speed, the workpiece 1 having its surface covered with the adhesive layer to form an adhesive surface thereof has this adhesive surface face downward. In other words, the adhesive surface of the workpiece 1 is oppositely disposed from the electrodes 5A, 5B in a condition in which the workpiece 1 has its adhesive surface always spaced a predetermined distance apart from the electrodes 5A, 5B so as to extend in parallel with the electrodes 5A, 5B when the workpiece 1 travels at high speed through the interior of the electrostatic flocking chamber 2.

By applying a high voltage electrostatic energy to these electrodes 5A, 5B, an electrostatic field is created between the workpiece 1 and the electrodes 5A, 5B so that the workpiece 1 is constantly subjected to the same strength of the electric lines of force appearing in the electrostatic field thus created.

In the embodiment, although the up-type, in which the adhesive surface of the workpiece 1 is urged downward for performing the electrostatic flocking operation of the workpiece 1, has been described, it is also possible to use the down-type in which the adhesive surface of the workpiece 1 is urged upward for performing the electrostatic flocking operation of the workpiece 1, wherein: the adhesive surface of the workpiece 1 urged upward forms an oblique angle of the workpiece 1; and, in line with such oblique angle of the workpiece 1, the electrodes 5A, 5B are arranged to effectively perform the electrostatic flocking operation of the workpiece 1.

In the electrostatic flocking operation, naturally the workpiece 1 requires no adhesive layer.

Finally, the present application claims the Convention Priority based on Japanese Patent Application No. Hei 11-235030 filed on Aug. 23, 1999, which is herein incorporated by reference.

What is claimed is:

1. A structure of an electrostatic processing chamber of an electrostatic flocking apparatus, wherein: a strip-like elongated workpiece is constructed of a metal strip of a material selected from the group consisting of ferrous metal and non-ferrous metal, wherein said metal strip has its surface coated with an adhesive layer to form said strip-like elongated workpiece which is wound into a coil, wherein said coil of said workpiece which is mounted on a delivery unit; said strip-like elongated workpiece is passed through an electrostatic flocking chamber at high speed so that said workpiece is electrostatically flocked with short fibers; after completion of such electrostatical flocking of said workpiece with said short fibers, said workpiece is subjected to an after-treatment, and then taken up in a take-up unit, characterized in that: a pressure roller (6) for forcibly defining a V-shaped oblique surface portion of said workpiece is arranged between a pair of conventional rollers each disposed in each of an inlet opening (3) and an outlet opening (4) of said electrostatic flocking chamber, wherein said V-shaped oblique surface portion of said workpiece corresponds in position to a curved surface portion of said workpiece formed due to said workpiece's own weight under the influence of gravity when said workpiece travels in a horizontal plane in the absence of said pressure roller (6) in said electrostatic flocking chamber; and, an electrode is disposed parallel to said V-shaped oblique surface portion of said workpiece.

2. A structure of an electrostatic processing chamber of an electrostatic coating apparatus, wherein: a strip-like elongated workpiece is constructed of a metal strip of a material selected from the group consisting of ferrous metal and non-ferrous metal, wherein said metal strip is wound into a coil, wherein said coil of said workpiece is mounted on a delivery unit; said strip-like elongated workpiece is passed through an electrostatic coating chamber at high speed so that said workpiece is electrostatically coated with an electrically insulating coating material; after completion of such electrostatical coating of said workpiece with said coating material, said workpiece is subjected to an after-treatment, and then taken up in a take-up unit, characterized in that: a pressure roller (6) for defining a V-shape oblique surface portion of said workpiece is arranged between a pair of conventional rollers each disposed in each of an inlet opening (3) and an outlet opening (4) of said electrostatic coating chamber, wherein said V-shaped oblique surface portion of said workpiece corresponds in position to a curved oblique surface portion of said workpiece formed due to said workpiece's own weight under the influence of gravity when said workpiece travels in a horizontal plane in the absence of said pressure roller (6) in said electrostatic coating chamber; and, an electrode is disposed parallel to said V-shaped oblique surface portion of said workpiece.

* * * * *